US005829998A

United States Patent [19]

Wandler et al.

[11] Patent Number: 5,829,998

[45] Date of Patent: Nov. 3, 1998

[54] ELECTRICAL CONNECTOR WITH FRONT LOADED COUPLING RING

[75] Inventors: David Wandler, Lockport; Raymond B. Simons, River Forest; Howard O. Wedell, Oak Forest, all of Ill.

[73] Assignee: Methode Electronics, Inc., Chicago, Ill.

[21] Appl. No.: 855,746

[22] Filed: May 8, 1997

Related U.S. Application Data

[63] Continuation of Ser. No. 373,583, Jan. 17, 1995, abandoned.

[51] Int. Cl.[6] ..... H01R 13/62

[52] U.S. Cl. ..... 439/312; 439/320; 439/357

[58] Field of Search ..... 439/312–323, 439/350, 352, 357

[56] References Cited

U.S. PATENT DOCUMENTS

| | | | |
|---|---|---|---|
| 2,757,351 | 7/1956 | Klostermann | 439/583 |
| 3,277,423 | 10/1966 | Rose | 439/357 |
| 5,100,341 | 3/1992 | Czyz et al. | 439/447 |
| 5,192,219 | 3/1993 | Flowler et al. | 439/321 |
| 5,318,457 | 6/1994 | Harting et al. | 439/357 |

FOREIGN PATENT DOCUMENTS

| | | | |
|---|---|---|---|
| 2002273 | 10/1969 | France | 439/321 |
| 2841876 | 4/1979 | Germany | 439/322 |

*Primary Examiner*—Hien Vu

*Attorney, Agent, or Firm*—Jeffrey H. Canfield; David L. Newman

[57] ABSTRACT

An electrical connector is provided having an easily attachable, front loading coupling ring having fingers and a receiving aperture having a chamfered edge for slidingly receiving a connector flange of a host connector and providing for a snap-fit of the coupling ring onto the host connector.

7 Claims, 3 Drawing Sheets

ELECTRICAL CONNECTOR WITH FRONT LOADED COUPLING RING

This is a continuation of application Ser. No. 08/373,583, filed Jan. 17, 1995, now abandoned.

BACKGROUND OF THE INVENTION

This invention generally relates to electrical connectors, and in particular, to an electrical connector having a front-loading coupling ring.

Electrical connectors are made in a variety of configurations so that a male plug is mateable with a female receptacle. It is known in the art for one of the connectors to include a coupling ring for mating the connector with a compatible connector. It is known for the coupling ring to have a screw thread or bayonet coupling configuration. It has been known in the art to attach the coupling ring to its host electrical connector by sliding the connector ring over the back end of the electrical connector, to be secured in place at the distal end of the connector. However, such methods of attaching coupling rings is difficult were the proximal or back end of the electrical connector has a large diameter. In many cases, the cables attached to the electrical connector are continually having larger and larger diameters requiring the proximal end of the electrical connector, for receiving the cables, to likewise have a large diameter. Thus, a coupling ring which is slid over the proximal end of the electrical connector would also have to have a large diameter in order to slide past the proximal end of the electrical connector. In some cases, such an arrangement would require a coupling ring to have an excessively large diameter, which would be incompatible to the electrical connector to be mated.

It is also known in the art to have a coupling ring which is attached to the electrical connector by sliding the coupling ring over the distal or front end of the electrical connector; or is front-loaded. Such front-loaded coupling rings which are known in the art have complicated means of attachment, such as use of lock washers and other components for attachment of the coupling ring to the front end of the electrical connector. Accordingly, there is desired a coupling ring which is easily and quickly attached to an electrical connector which does not require additional components for attachment or enlarging of the coupling ring diameter in order to facilitate its assembly from the rear end of the electrical connector.

Therefore, it an object of the present invention to provide an electrical connector having a coupling ring which is easily, inexpensively and quickly assembled.

It is a further object of the present invention to provide a coupling ring which may be mounted to an electrical connector via front-loading.

It is another object of the present invention to provide a coupling ring which may be quickly and inexpensively manufactured.

SUMMARY OF THE INVENTION

A principal object of this invention is to provide a host electrical connector comprising a connector body having a front and rear end. Mounted to the front end is a coupling ring which is snap-fit over a flange at the front end of the connector. The coupling ring includes a first end for attachment to the host connector, having expandable fingers and a second end for coupling the host connector to a compatible connector. The first end of the coupling ring includes a host receiving aperture for receiving the flange having a first diameter, the aperture having a second diameter greater than the first diameter. A third diameter of the aperture less than the diameter of the first diameter. The second end of the coupling ring includes a bayonet configuration. In another embodiment the second end of the coupling ring includes a threaded interior surface.

A method of attaching a coupling ring to a host connector includes the steps of sliding a first end of a coupling ring over a front end of a host connector having a connector flange having a first diameter. The first end of the coupling ring having a host receiving aperture, having a second diameter less than the first diameter, coming into abutting relationship with the flange. Pushing the coupling ring onto the front end of the host connector and causing the frictional engagement of the connector flange against the flange receiving aperture and causing the coupling ring fingers to expand. Pushing the connector flange past the second diameter of the flange receiving aperture of the coupling ring. Mounting of the coupling ring via a snap-fit over the flange and retraction of the fingers of the coupling ring, wherein said coupling is secured to the host connector.

These and other features of the invention are set forth below in the following detailed description of the presently preferred embodiments.

DETAILED DESCRIPTION OF THE PRESENTLY PREFERRED EMBODIMENTS

Figure 1:
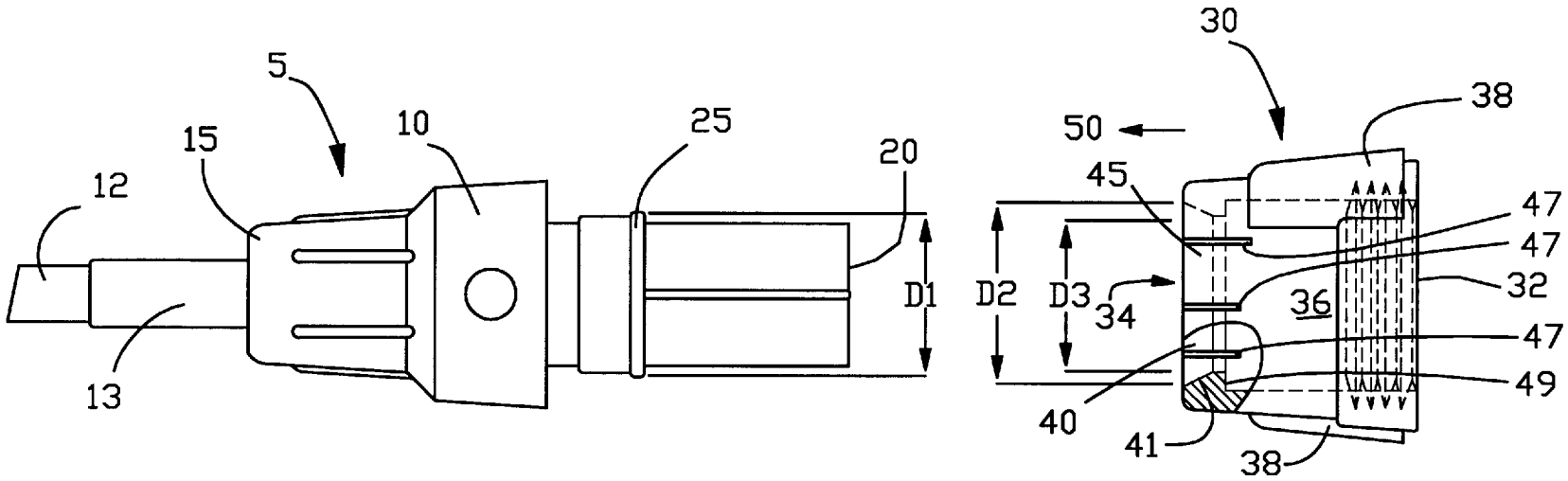
FIG. 1 is a side elevation view of the electrical connector of the present invention before mounting of the coupling ring having a partially cut-away view.
Figure 2:
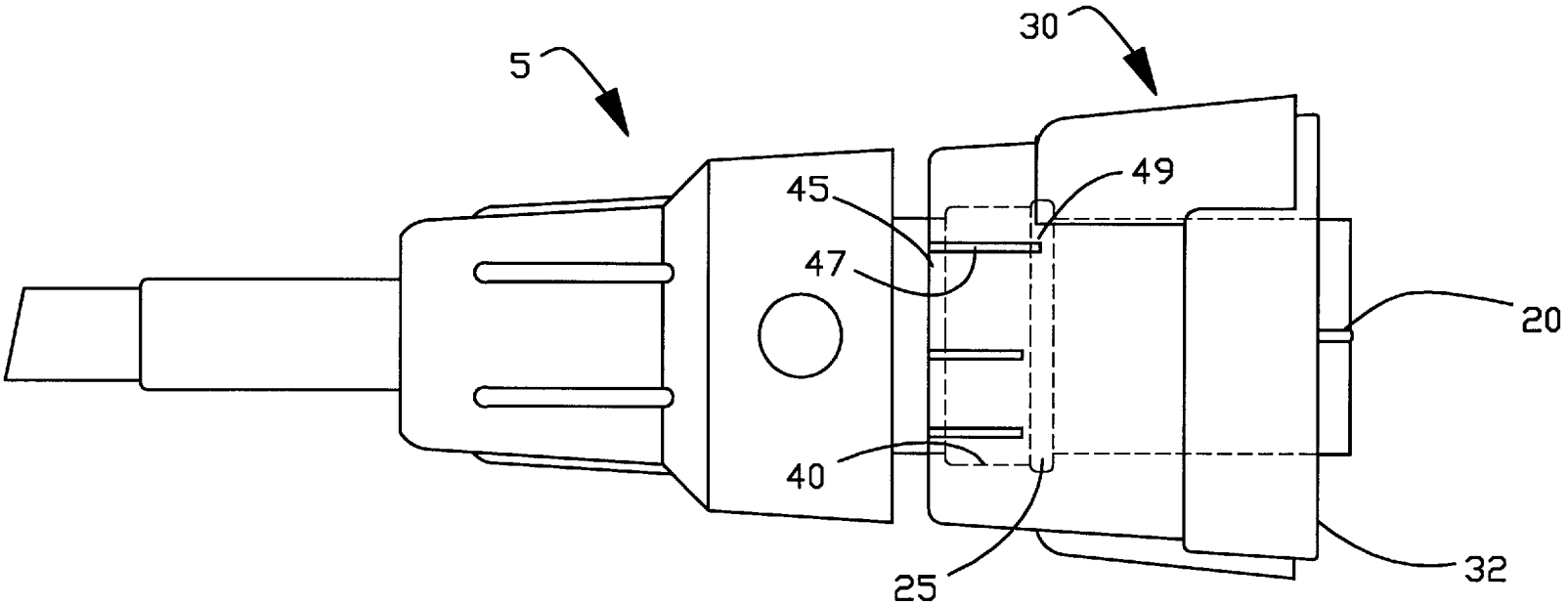
FIG. 2 is a side elevation view of the electrical connector of the present invention having the coupling ring mounted thereto.
Figure 3:
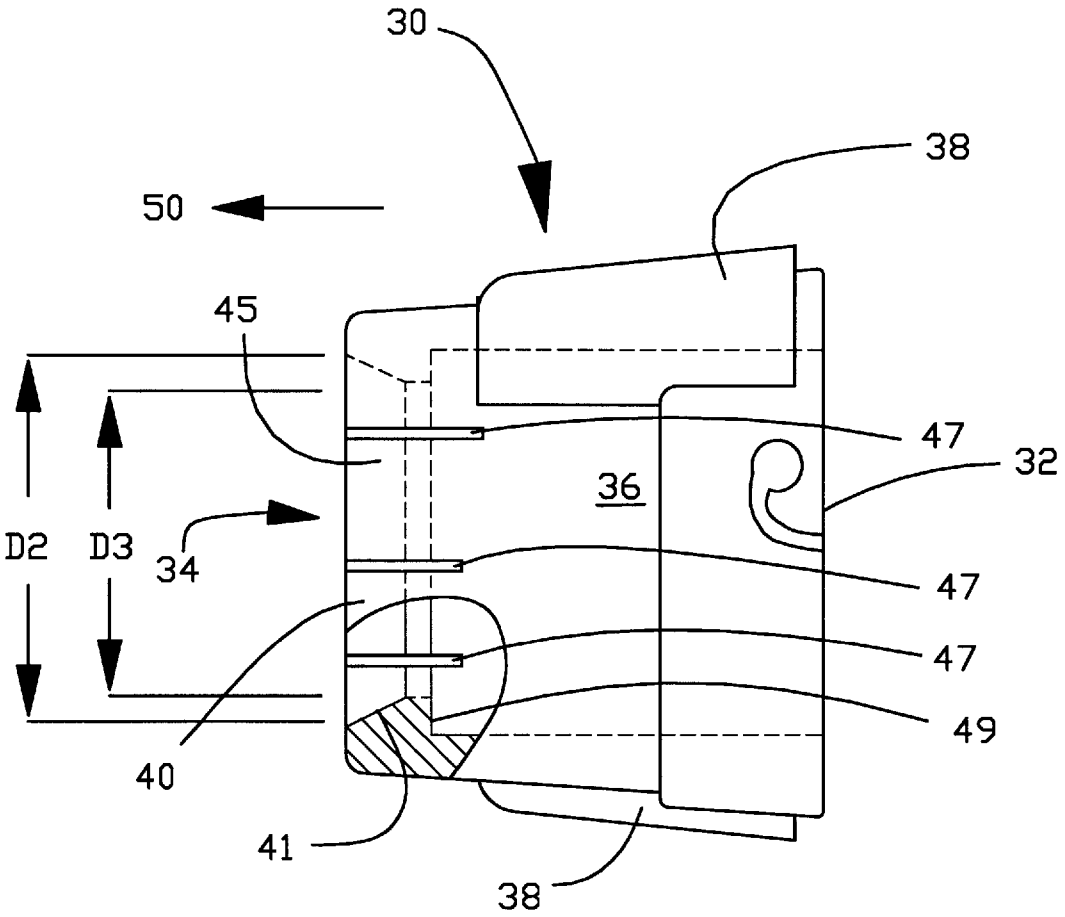
FIG. 3 is a side elevation of a coupling ring according to the present invention having a bayonet mating configuration.

The present invention relates to an electrical connector best understood by referring to FIGS. 1 and 2. Host connector 5 is shown having connector body 10 having a cable 12 attached to the rear end 15 or the proximal end. A strain relief boot 13 attaches the cable 12 to the connector body 10 at the rear end 15. Opposite the rear end 15 of the connector 5 is front end 20 or distal end. The front end 20 of the connector may have either female sockets or male pins. Oriented a distance from the front end 20 is connector locking flange 25. The connector locking flange 25 has a first diameter D1. FIG. 1 shows the host connector 5 prior to attachment of the coupling ring 30. The coupling ring includes a first end 3 for attachment to host connector 5 and second end 32 for coupling to a compatible connector. The coupling ring 30 includes an outer shell 36 which, in a preferred embodiment, is cylindrical in order to be compatible with the cylindrical host connector 5. Gripping surfaces 38 are provided for aiding in the twisting attachment of the coupling ring 30 to a compatible connector.

FIG. 1 shows the coupling ring 30 having a partially cut-away view of the shell 36, so that the interior of the coupling ring may be viewed. Host connector receiving aperture 40 is shown having a chamfered edge 41 for engaging the connector flange 25 of the host connector 5. The receiving aperture 40 has at its widest point a second diameter D2 and at its narrowest point a third diameter D3. The second diameter D2 of the receiving aperture 40 is larger than the first diameter D1 of the connector flange 25. The third diameter D3 of the attachment aperture 40 is smaller than the first diameter D1 of the connector flange 25. The receiving end 34 of the coupling ring 30 also includes fingers 45 spaced around the circumference of the first end 34 and receiving aperture 40. The fingers 45 are separated by slots 47.

Upon mounting of the coupling ring 30 to the host connector 5, the coupling ring 30 is moved in direction of arrow 50 towards the front end 20 of the connector 5. The front end portion 20 of the connector 5 has a diameter which is less than the third diameter D3 of the receiving aperture 40. Thus, the front end 20 of the connector 5 will slide through the receiving aperture 40 without interference. Upon further movement of the coupling ring 30 in direction of arrow 50, the connector flange 25 will come into abutting contact with chamfer 41. As the coupling ring 30 is pushed further, the connector flange 25 will ride along the chamfer 41 and cause the fingers 45 to expand and the slots 47 to widen. In a preferred embodiment, the coupling ring 30 is molded of a polymer material such as Radel® (Amoco Corporation) which provides for sufficient resilience to the fingers 45 to flex outwardly. The forced insertion of the coupling ring 30 over connector flange 25 causes the expansion of the receiving aperture 40 larger than the third diameter D3 to allow for the connector flange 25 to pass therethrough.

Turning to FIG. 2, the coupling ring 30 is shown in its fully mated position on the host connector 5. It can be seen that the connector flange 25 has been inserted through the receiving aperture 40 and the coupling ring 30 has been snap-fit over the flange 25. After the connector flange 25 is force fit through the receiving aperture 40, the fingers 45 contract and slots 47 return to their original width. The third diameter D3 of the receiving aperture 40 also returns to its original width; which is less than the first diameter of the connector flange 25, so that the connector flange 25 abuts against chamber wall 49 and cannot return through the receiving aperture 40. Thus the coupling ring 30 is locked onto the host connector 5. The front end 20 of the host connector 5 extends beyond the second end 32 of the coupling ring 30 for insertion into a compatible connector. Upon mating with a compatible connector, the coupling ring may be moved into a coupling relationship with the compatible connector, allowing for the simple mating of the host connector 5. The second end of the coupling ring can be formed with a bayonet mating configuration or a threaded interior surface to facilitate the coupling of the coupling ring to a compatible connector.

It can thus be appreciated that the present coupling ring 30 is easily and simply attached to a host connector 5 without need of additional parts and from the front end 20. In a preferred embodiment, the coupling ring 30 is mounted to host connector 5 by use of an Arbor press. However, in an alternative embodiment, the slots 47 may be lengthened in order to increase the length of the cantilever beam of the fingers 45 so that less force is needed to attach the coupling ring 30 to the host connector 5. In such an embodiment, the coupling ring 30 may be mounted to the host connector by hand.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electrical connector comprising:

a cylindrical host connector housing having a front end for engaging a suitable companion connector, a back end for connection to an electrical cable, and an annular locking flange extending around an outer diameter of the host connector housing, said annular locking flange having a locking flange diameter which is greater than the outer diameter of the host connector, and the locking flange being located between the front and back ends of the housing; and an annular coupling ring insertable over the front end of the host connector housing, the coupling ring having a flange receiving end including flexible fingers defining an elastic aperture having a chamfered edge, the chamfer defining a first aperture diameter and a second aperture diameter, the first aperture diameter being greater than the locking flange diameter, and said second aperture diameter being less than said locking flange diameter, the flexible finders displacing to allow the annular locking flange to pass the elastic aperture as the coupling ring is inserted over the flange from the front end toward the back end of the host connector housing, the flexible fingers returning to their original position upon further insertion of the coupling ring to a location where the elastic aperture is positioned between the locking flange and the back end of the connector housing, the locking flange and the elastic aperture thereby forming a front loading detent without requiring the coupling ring to pass over the back end of the connector housing, the detent preventing the coupling ring from being withdrawn over the front end of the connector housing while allowing the coupling ring to rotate freely about the connector housing, the coupling ring further having an integral coupling end opposite the flange receiving end, the coupling end providing coupling means for securing the connector housing to a mating connector.

2. The electrical connector of claim 1 wherein said coupling ring includes slots separating said fingers.

3. The electrical connector of claim 1 wherein said coupling means for securing the connector housing to a mating connector comprises a bayonet mating configuration.

4. The electrical connector of claim 1 wherein said coupling means for securing the connector housing to a mating connector comprises a threaded interior surface.

5. An electrical front loading coupling ring for coupling a first electrical connector to a second, mating electrical connector, the electrical connector being cylindrical in shape, having a front end having a front connector diameter, and a back end having a back connector diameter, and a locking flange having a flange diameter, said coupling ring comprising:

an annular insulated member configured to insertably mount over the front end of said first electrical connector;

said annular insulated member having gripping surfaces disposed on an outer surface thereof for rotatably mating said annular insulated member to said second electrical connector, said annular insulate member further having a first end defining a flange receiving aperture for receiving the front end of the host connector including the locking flange;

said flange receiving aperture having a chamfered edge such that a first outer diameter is greater than a second inner diameter, said first outer diameter being greater than said flange diameter and said second inner diameter being less than said flange diameter, said aperture being further defined by flexible fingers disposed around the circumference thereof allowing said aperture to expand over said locking flange as the annular member is inserted onto said first electrical connector, the locking flange cooperating with the smaller inner diameter of said flange receiving aperture to prevent coupling ring from being removed from in said first connector, and said first outer diameter being smaller than the back connector diameter thereby preventing the annular member from passing over the back end of the first electrical connector, and said annular member being freely rotatable around said first connector;

said annular member further having a second end opposite said first end, said second end provided with coupling means for rotatably joining the coupling ring to a mating connector.

6. The coupling ring of claim 5 wherein said coupling means for joining the coupling ring to a mating connector comprises a bayonet mating configuration.

7. The electrical connector of claim 5 wherein said coupling means for joining the coupling ring to a mating connector comprises a threaded interior surface.

* * * * *